US006184792B1

(12) United States Patent
Privalov et al.

(10) Patent No.: US 6,184,792 B1
(45) Date of Patent: Feb. 6, 2001

(54) EARLY FIRE DETECTION METHOD AND APPARATUS

(76) Inventors: George Privalov, 215 Overkill Rd., Baltimore, MD (US) 21210; Dimitri Privalov, 37a Leninski pr., Apt 25, 117334 Moscow (RU)

( * ) Notice: Under 35 U.S.C. 154(b), the term of this patent shall be extended for 0 days.

(21) Appl. No.: 09/552,688

(22) Filed: Apr. 19, 2000

(51) Int. Cl.[7] ..... G08B 17/12

(52) U.S. Cl. ..... 340/578; 340/577; 250/336.1; 250/339.15; 700/274; 348/82; 382/100; 382/195; 382/203; 382/225

(58) Field of Search ..... 340/578, 577; 431/14, 76, 75; 250/554, 336.1, 339.15; 700/274; 348/82, 61; 358/108; 382/100, 191, 203, 181, 195, 225

(56) References Cited

U.S. PATENT DOCUMENTS

| | | | | |
|---|---|---|---|---|
| 5,153,722 | | 10/1992 | Goedeke et al. | 358/108 |
| 5,191,220 | | 3/1993 | Innes | 250/554 |
| 5,202,759 | * | 4/1993 | Laycock | 348/152 |
| 5,249,954 | * | 10/1993 | Allen et al. | 431/14 |
| 5,289,275 | * | 2/1994 | Ishii et al. | 348/154 |
| 5,510,772 | | 4/1996 | Lasenby | 340/578 |
| 5,594,421 | | 1/1997 | Thuillard | 340/578 |
| 5,625,342 | | 4/1997 | Hall et al. | 340/578 |
| 5,726,632 | | 3/1998 | Barnes et al. | 340/577 |
| 5,751,209 | | 5/1998 | Werner | 340/286.05 |
| 5,777,548 | * | 7/1998 | Murakami et al. | 340/506 |
| 5,796,342 | | 8/1998 | Panov | 340/577 |
| 5,798,946 | * | 8/1998 | Khesin | 700/274 |
| 5,832,187 | | 11/1998 | Pedersen et al. | 395/50 |
| 5,838,242 | | 11/1998 | Marsden | 340/628 |
| 5,850,182 | | 12/1998 | Schuler | 340/578 |
| 5,926,280 | | 7/1999 | Yamagishi et al. | 356/390 |
| 5,937,077 | * | 8/1999 | Chan et al. | 382/100 |
| 5,971,747 | * | 10/1999 | Lemelson et al. | 431/12 |
| 5,995,008 | | 11/1999 | King et al. | 340/578 |
| 6,011,464 | * | 1/2000 | Thuillard | 340/506 |
| 6,111,511 | * | 8/2000 | Sivathanu et al. | 340/577 |

* cited by examiner

*Primary Examiner*—Benjamin C. Lee
(74) *Attorney, Agent, or Firm*—Larry J. Guffey

(57) ABSTRACT

The present invention provides a method and apparatus for detecting fire in a monitored area. In a preferred embodiment, this method is seen to comprise the steps of: (1) capturing video images of the monitored area in the form of two-dimensional bitmaps whose spatial resolution is determined by the number of pixels comprising the bitmaps, (2) cyclically accumulating a sequential set of these captured bitmaps for analysis of the temporal variations being experienced in the pixel brightness values, (3) examining these sets of bitmaps to identify clusters of contiguous pixels having either a specified static component or a specified dynamic component of their temporally varying brightness values, (4) comparing the patterns of the shapes of these identified, static and dynamic clusters to identify those exhibiting patterns which are similar to those exhibited by the comparable bright static core and the dynamic crown regions of flickering open flames, and (5) signaling the detection of a fire in the monitored area when the degree of match between these identified, static and dynamic clusters and the comparable regions of flickering open flames exceeds a prescribed matching threshold value.

20 Claims, 6 Drawing Sheets

EARLY FIRE DETECTION METHOD AND APPARATUS

BACKGROUND OF THE INVENTION

1. Field of the Invention

The present invention generally relates to electrical, condition responsive systems. More particularly, this invention relates to a method and apparatus for detecting a fire in a monitored area.

2. Description of the Related Art

It is important that an optical fire detector be able to detect the presence of various types of flames in as reliable a manner as possible. This requires that a flame detector be able to discriminate between flames and other light sources. Commonly, such optical flame detection is carried out in the infrared (IR) portion of the light spectrum at around 4.5 microns, a wavelength that is characteristic of an emission peak for carbon dioxide.

Simple flame detectors employ a single sensor, and a warning is provided whenever the signal sensed by the detectors exceeds a particular threshold value. However, this simple approach suffers from false triggering, because it is unable to discriminate between flames and other bright objects, such as incandescent light bulbs, hot industrial processes such as welding, and sometimes even sunlight and warm hands waved in front of the detector.

Attempts have been made to overcome this problem by sensing radiation at two or more wavelengths. For example, see U.S. Pat. No. 5,625,342. Such comparisons of the relative strengths of the signals sensed at each wavelength have been found to permit greater discrimination regarding false sources than when sensing at only a single wavelength. However, such detectors can still be subject to high rates of false alarms.

Another technique for minimizing the occurrence of such false alarms is to use flicker detection circuitry which monitors radiation intensity variations over time, and thereby discriminate between a flickering flame source and a relatively constant intensity source such as a hot object.

Meanwhile, U.S. Pat. No. 5,510,772 attempts to minimize such false fire alarms by using a camera operating in the near infrared range to capture a succession of images of the space to be monitored. The brightness or intensity of the pixels comprising these images is converted to a binary value by comparing it with the average intensity value for the image (e.g., 1 if greater than the average). Computing for each pixel a crossing frequency, v (defined as the number of times that its binary value changes divided by the II number of images captured) and an average pixel binary value, C (defined as the average over all the images for a specific pixel). Testing the values of v and C against the relationship: $v=KC(1-C)$, where K is a constant; and signaling the existence of a fire for any cluster of adjacent pixels for which the respective values of v and C fit this relationship within predetermined limits.

Despite such improvement efforts, these fire detectors can still be subject to high rates of false alarms, and misdiagnosis of true fires. For example, there can still be significant difficulties in producing true alarms when monitoring fires at a long distance from the detector, say up to approximately two hundred feet, when the signal to noise ratio is small. This may present even higher challenge when other active or passive light sources are present, such as spot welding, reflecting surfaces of water, flickering luminescent light fixtures etc.

Also, fire detectors suffer from an inconsistency in fire detection characteristics under different fire conditions, such as with different levels of fire temperature, size, position relative to the detector, fuel and interfering background radiation. Additionally, such detectors have little ability to pinpoint the exact location of a fire in a monitored area; information which can greatly aid the effective use of installed suppression systems. Consequently, there is still a need for a fire detector with exact fire location capabilities and whose ability to detect fires is less dependent on the various factors listed above.

SUMMARY OF THE INVENTION

The present invention is generally directed to satisfying the needs set forth above and the problems identified with prior fire detection systems and methods.

In accordance with one preferred embodiment of the present invention, the foregoing needs can be satisfied by providing a method for detecting fire in a monitored area that comprises the steps of. (1) capturing video images of the monitored area in the form of two-dimensional bitmaps whose spatial resolution is determined by the number of pixels comprising the bitmaps, (2) cyclically accumulating a sequential set of these captured bitmaps for analysis of the temporal variations being experienced in the pixel brightness values, (3) examining these sets of bitmaps to identify clusters of contiguous pixels having either a specified static component or a specified dynamic component of their temporally varying brightness values, (4) comparing the patterns of the shapes of these identified, static and dynamic clusters to identify those exhibiting patterns which are similar to those exhibited by the comparable bright static core and the dynamic crown regions of flickering open flames, and (5) signaling the detection of a fire in the monitored area when the degree of match between these identified, static and dynamic clusters and the comparable regions of flickering open flames exceeds a prescribed matching threshold value.

In another preferred embodiment, the present invention is seen to take the form of an apparatus for detecting a fire in a monitored area. This apparatus incorporates a CCD-based, video camera preferably operating in the near IR region of spectra with built-in video processing circuitry that is commercially available. For example, an accumulation buffer may provide the necessary storage to allow for the further digital filtering of the camera's video signal, which may be accomplished using microcontroller-based, electronic components, such as video decoders and digital signal processor (DSP) chips.

It is therefore an object of the present invention to provide a fire detection method and apparatus that minimizes the occurrences of high rates of false alarms, and the misdiagnosis of true fires.

It is another object of the present invention to provide a fire detection method and apparatus that can accurately monitor fires at a long distance from the detector, say up to approximately two hundred feet, when the signal to noise ratio for the prior art detectors would be small.

It is a yet another object of the present invention to provide a fire detection method and apparatus whose ability to detect fires is less dependent on different fire conditions, such as with different levels of fire temperature, size, position relative to the detector, fuel and interfering background radiation.

It is a further object of the present invention to provide a fire detection method and apparatus based on distinguishing the flickering crown and static core regions of an open flame.

These and other objects and advantages of the present invention will become readily apparent as the invention is better understood by reference to the accompanying drawings and the detailed description that follows.

DESCRIPTION OF THE PREFERRED EMBODIMENT

Figure 2:
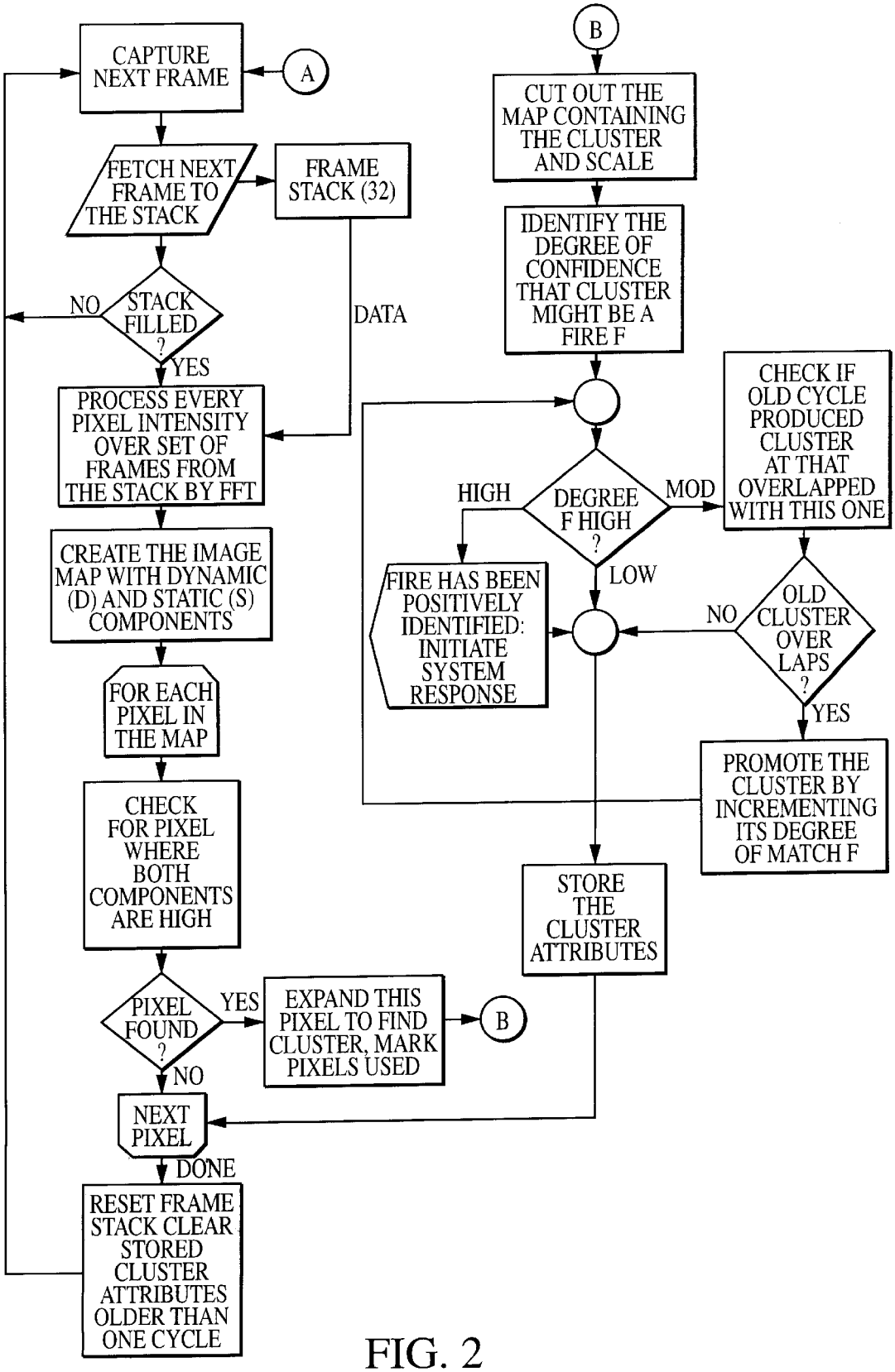
FIG. 2 is a flow chart showing the various process steps carried out in one embodiment of the present invention.

Referring now to the drawings wherein are shown preferred embodiments and wherein like reference numerals designate like elements throughout, there is shown in FIG. 2 an embodiment of the present invention in the form of a method for detecting fire in a monitored area.

This method is generally seen to comprise the steps of: (a) detecting and capturing, at a prescribed frequency, video images of the monitored area in the form of two-dimensional bitmaps whose spatial resolution is determined by the number of pixels comprising said bitmaps, (b) cyclically accumulating a sequential set of these captured bitmaps for analysis of the temporal variations in the brightness values observed at each of the pixels, wherein these temporal variations are expressible in terms of a static and a dynamic component of the variations in pixel brightness values, (c) examining these set of bitmaps to identify a static cluster and a dynamic cluster of contiguous pixels having brightness values that, respectively, exceed prescribed static and dynamic threshold magnitudes, (d) comparing the patterns of the shapes of said identified, static and dynamic clusters to identify those exhibiting patterns which match to a predetermined matching level those exhibited by the comparable static core and dynamic, flickering coronal regions of a turbulent, open flame, and (e) signaling the detection of a fire in the monitored area when the degree of match, between the identified, static and dynamic clusters and the comparable regions of an open flame, exceeds the predetermined matching level.

Figure 1:
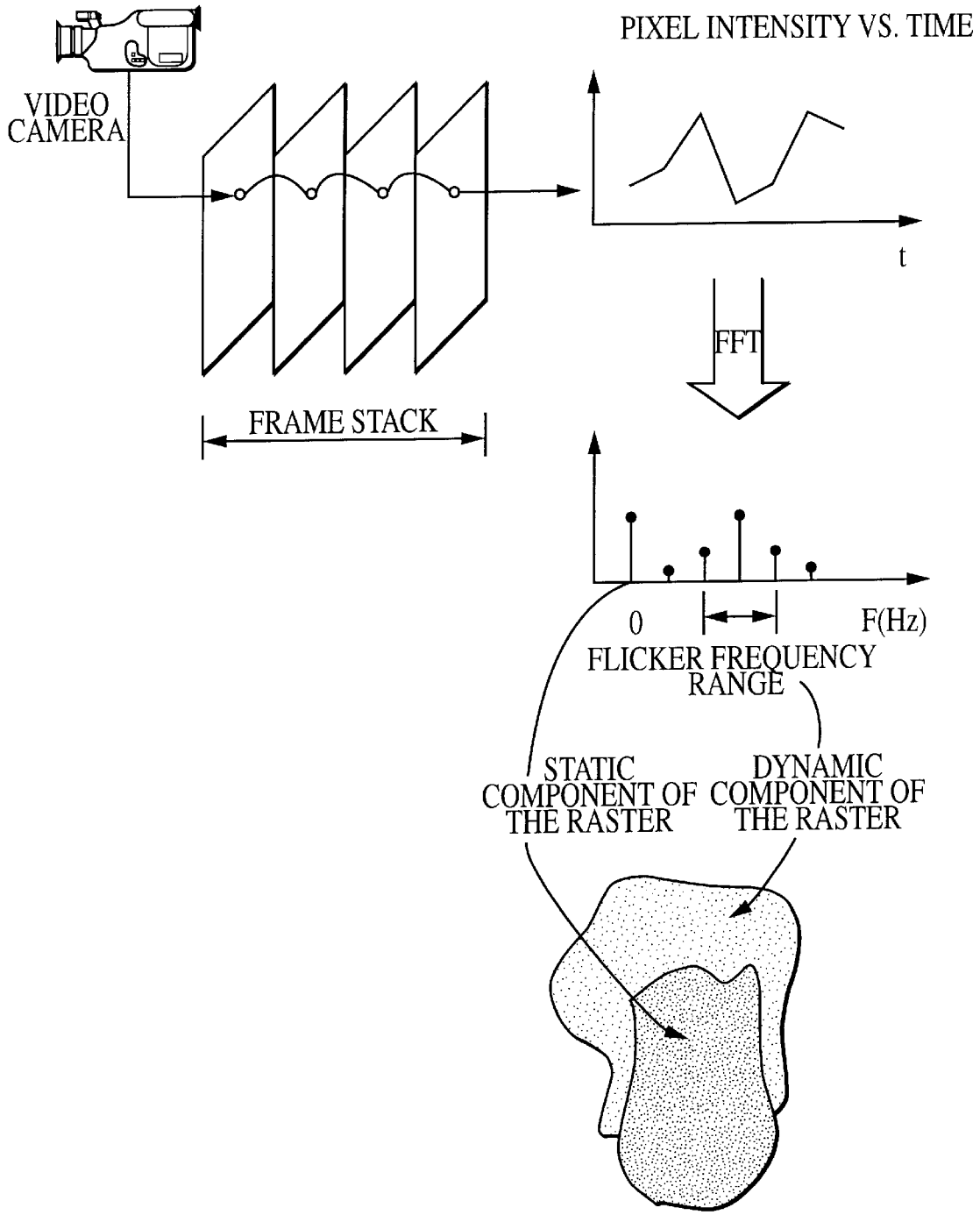
FIG. 1 illustrates the various forms of data that are encountered and analyzed using a preferred embodiment of the present invention.

FIG. 1 further illustrates this method by generally illustrating the various forms of data that are encountered and analyzed using this method. In this embodiment, a digital video camera provides a means for detecting and capturing, at a prescribed frequency (e.g., 16 frames per second) and spatial resolution (e.g., 160×120 pixels), video frames or bitmap images of an area that is to be temporally monitored for the outbreak of an open flame fire. These frames, $F_1$, $F_2$, . . . $F_i$, are stored in an accumulation buffer, the storage capacity of which determines the size of the sequential data sets that are cyclically analyzed to identify the presence of an open flame (e.g., an accumulation buffer providing storage for 16 frames, with the analysis cycle being of one second duration).

This analysis process involves an examination of the temporal variations in the intensity or brightness at each of the pixels that comprise the respective video frames or bitmaps. These temporal variations for the various pixels may be quite complex. However, for the purpose of this analysis, it proves satisfactory to describe these variations only in terms of the amplitudes of their steady-state or static component and a specific dynamic component. This is defined to be the dynamic component that is centered around five cycles per second (i.e., 5 hertz, Hz), since this has been found to be the characteristic frequency component of the intensity fluctuations observed in the flickering, coronal regions of open, turbulent flames.

For the purpose of the present embodiment, these measures are computed by performing a Fast Fourier Transform (FFT) on the temporally varying, pixel intensities. The measure of the static component is taken to be the zero FFT term, (i.e., mean brightness value), while the sum of the three FFT terms centered around 5 Hz are taken as the measure of the dynamic component. However, similar end results were obtained when using Digital Signal Processing techniques with Humming windows (that is not to suggest that Humming window is the only technique possible). In addition, the dynamic component can be determined by simply counting how many times the intensity signal crosses its mean value within each analysis cycle.

Thus, an intermediate result of each cycle of this analysis are two calculated bitmaps in which each pixel is assigned the calculated values of the prescribed static and dynamic components.

The analysis continues, as shown in FIG. 2, by identifying whether any of the calculated bitmap's contiguous pixels have either static or dynamic components that exceed prescribed threshold values. If so, the extent and comparative shapes of such calculated bitmap regions, denoted as clusters, are noted for still further analysis.

This further analysis is predicated upon the finding that the comparative shapes of such clusters lie within clearly distinguishable bounds when such clusters are due to the existence of an open flame within a monitored area. Thus, an analysis of the comparative shapes of such clusters can be used as a means for identifying the existence of an open flame within a monitored area.

Figure 2A:
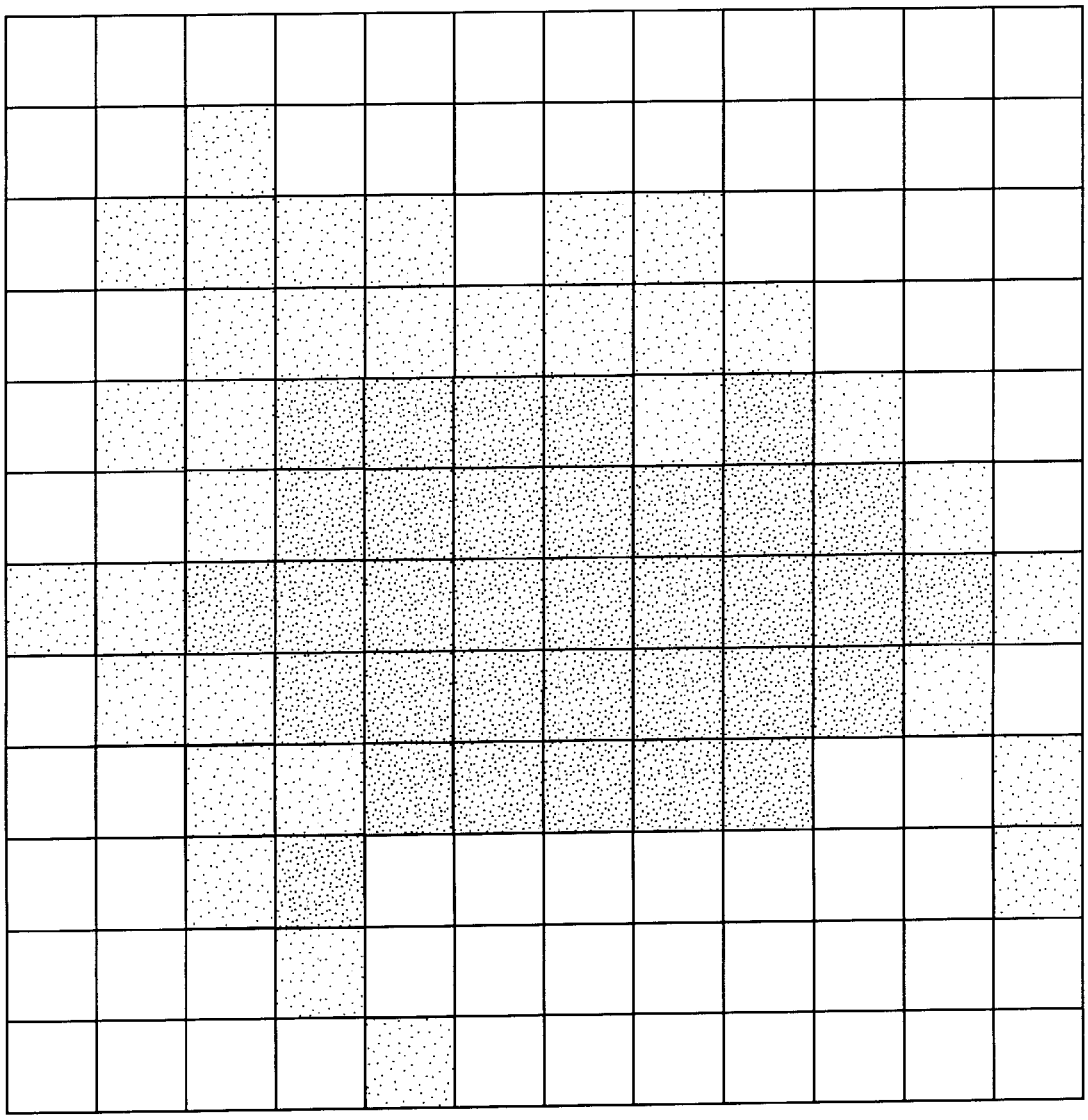
FIG. 2*a* illustrates a typical bitmap pattern of the present invention, where the dynamic and static component pixels have been filled, respectively, with diagonal hatching and cross hatching.

If the area defined by a specific cluster exceeds a prescribed magnitude, this area is copied and scaled onto a standard 12×12 size bitmap for specific pattern matching. FIG. 2*a* shows such a typical bitmap pattern for an open flame, where the dynamic component pixels have been filled with diagonal hatching while the static component pixels have been filled with cross hatching. For pattern matching, any one of a number of standard and well-known techniques may be employed.

For example, to calculate a degree of match, one may compute the correlation factors between each bitmap pattern (D dynamic matrix and S static matrix component) and known matrix patterns $D^{\sim}$ and $S^{\sim}$ that have been previously determined by averaging over a large sample of bitmap patterns produced by video images of real, open flame fires. Examples of such known matrix patterns for these 12×12 bitmaps are shown below:

| For the static component, $S^-$ | For the dynamic component, $D^-$ |
|---|---|
| 000000000000 | 005559955500 |
| 000000000000 | 058999999850 |
| 000005500000 | 599999999995 |
| 000567765000 | 799975579997 |
| 005678876500 | 799753357997 |
| 056789987650 | 897530035798 |
| 068999999860 | 765000000567 |
| 068999999860 | 765000000567 |
| 056789987650 | 765000000567 |
| 005678876500 | 592000000295 |
| 000567765000 | 023455554520 |
| 000567765000 | 002333333200 |

where the matrix's values have been scaled to the range of 0–9.

The product of the two correlation factors for the dynamic and static components can then be defined as the degree of confidence, C, of the identified clusters being a fire:

$$C=D\cdot D^{-}\times S\cdot S^{-}$$

The product of this value and angular size of the original cluster, S°, can then be used to determine the degree of danger that particular clusters represent in terms of being a fire during a specific analysis cycle i:

$$F^{i}=C\times S^{\circ}$$

For values F that are higher then prescribed threshold value, FIG. 2 indicates that at step 15 the analysis procedure proceeds with the initiation of a positive identification response, as shown in step 17. If the value $F^i$ is below the threshold, but still significant, the position of the respective cluster is, as shown in step 16 of FIG. 2, compared to the results of analysis from previous cycle $F^{i-1}$. If the cluster overlaps with position of another cluster that produced $F^{i-1}$ value, the cluster is promoted, as shown at step 19 of FIG. 2 (i.e., its $F^i$ value is increased proportionally to $F^{i-1}S_{ovl}$, where $S_{ovl}$ is the angular area of the overlap of clusters $F^i$ and $F^{i-1}$). This insures that smaller but consistent fire clusters still produce positive identification within several analysis cycles.

This analysis cycle concludes with the storing of the attributes of identified clusters for later comparison with the attributes (e.g., cluster angular position, fire danger levels, $F^i$) of subsequently identified clusters.

Figure 3:
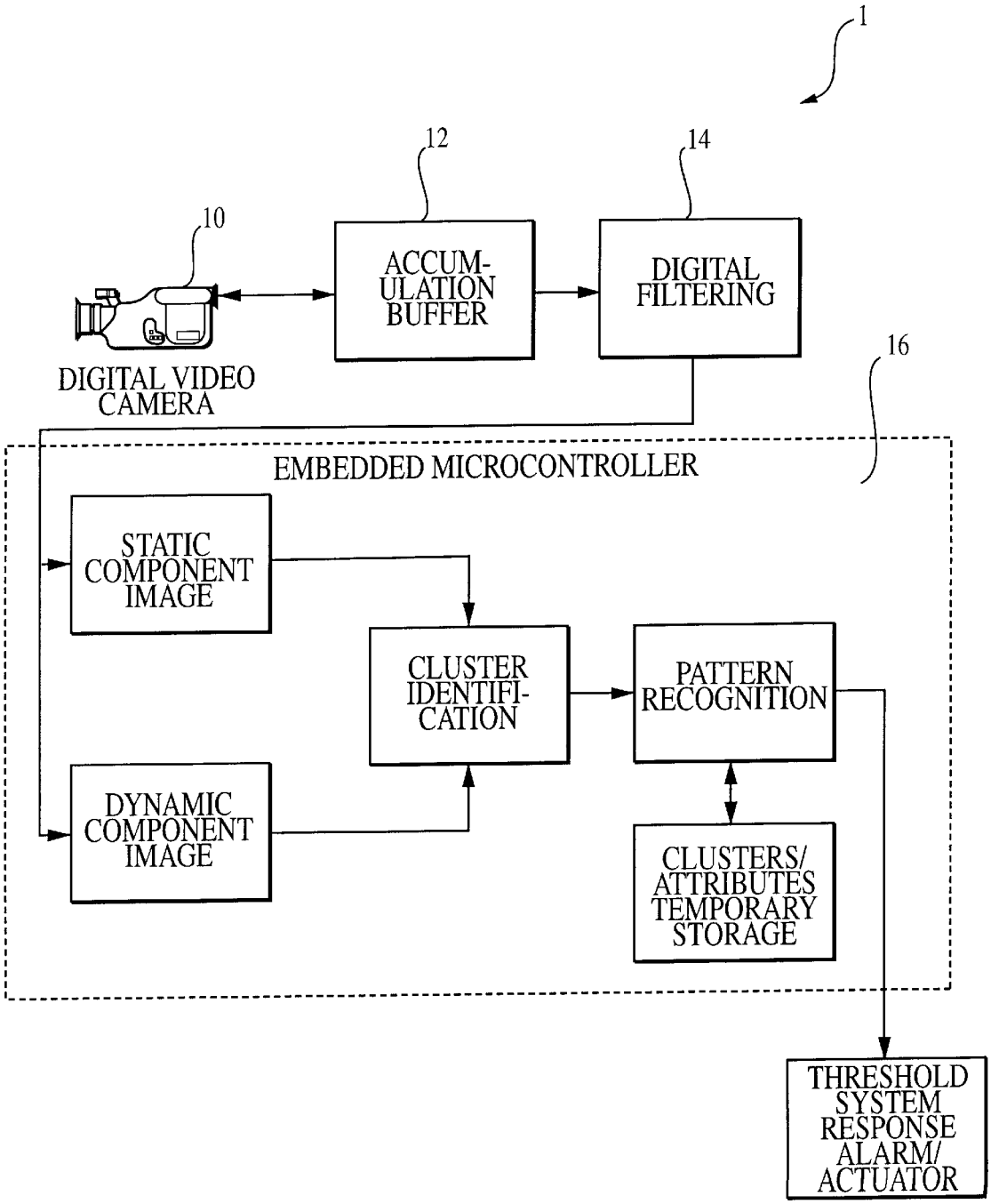
FIG. 3 illustrates how data flows through the various elements comprising an embodiment of the present invention in the form of a fire detecting apparatus.

In another embodiment, the present invention takes the form of an apparatus (1) for detecting fire in a monitored area. FIG. 3 illustrates how data flows through such an embodiment. It can be seen that the nature of these data flows and their required computational procedures may be distributed among relatively inexpensive, microcontroller-based, electronic components, such as video decoders, digital signal processor (DSP) chips and an embedded microcontroller. In one embodiment of present invention, a 330 MHz, Pentium-based, personal computer running under the Microsoft Windows operating system was used with a USB TV camera, which was manufactured by 3Com. Video capture was achieved via standard Windows multimedia services. The process algorithm shown in FIG. 2 was implemented using a Visual C++ compiler. It provided the monitoring window that displayed the video information captured by the camera.

FIG. 3 shows that a charge coupled device (CCD) digital video camera (10), preferably operating in the near infrared range, is used to generate a video signal in form of consecutive bitmap images that are stored in a first-in, first-out (FIFO) accumulation buffer (12) that provides the necessary storage to allow for further digital filtering of the camera's video signal. An important detail of this apparatus is the organization of the video data in the accumulation buffer (12) so that it is possible to use a standard digital signal processor (DSP) chip (14) to produce the dynamic and static components of the video image.

Figure 4:
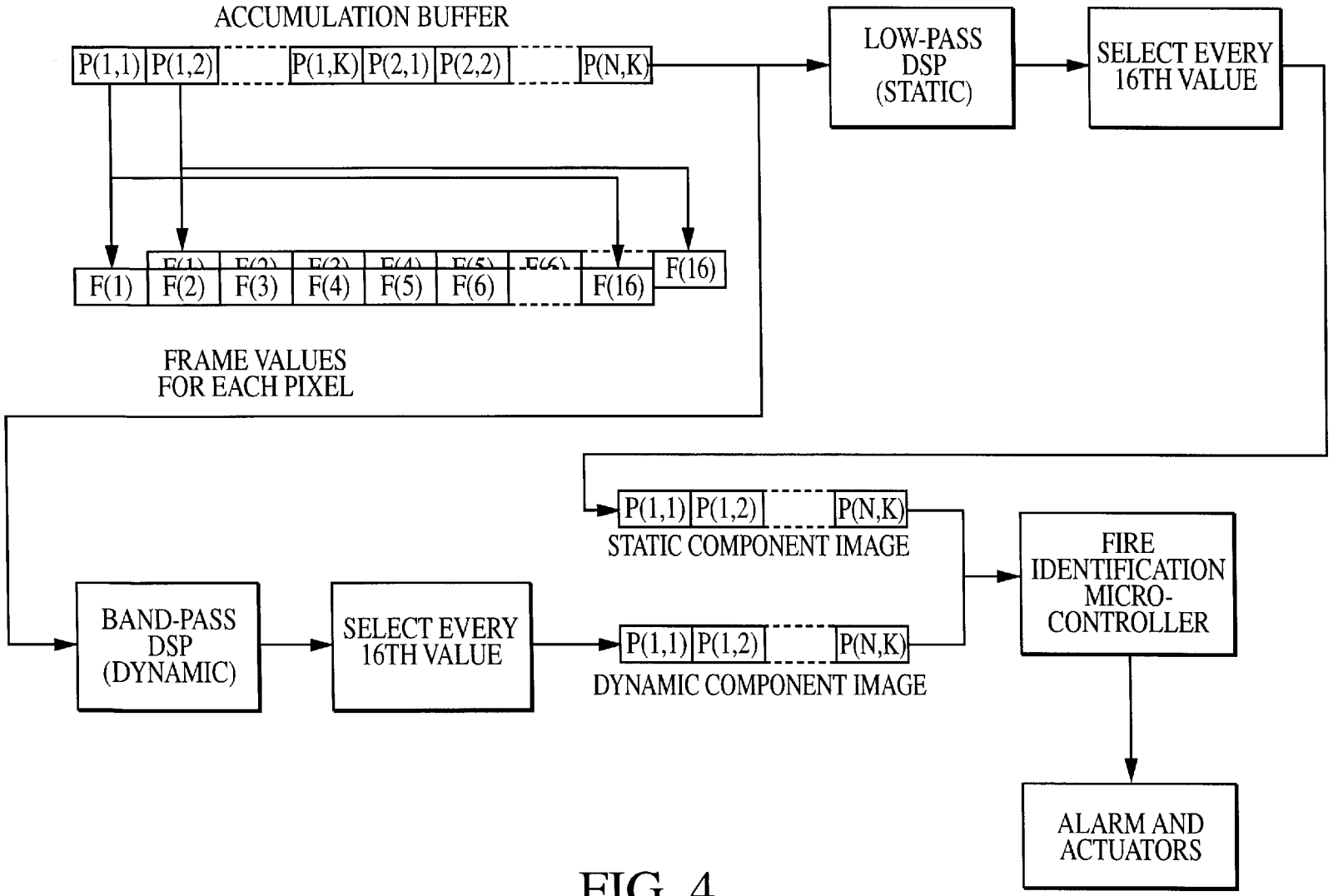
FIG. 4 illustrates the details of the memory organization within a data accumulation buffer of the apparatus referenced in FIG. 3.

FIG. 4 illustrates the details of the memory organization within this buffer. The entire buffer memory (12) is seen to be broken into paragraphs containing as many paragraphs as there are pixels in each frame. Every paragraph contains sixteen brightness values from consecutive frames that belong to a given pixel.

Once the buffer is filled, the entire buffer is passed through one or more DSP chips. For simplicity, two DSP chips are shown in FIG. 4, a low-pass DSP for the static image component and a band-pass DSP for the dynamic image component. At the output of each DSP, every 16-th value in the sequence is selected and, using an internal index counter, dispatched to the address of a specific pixel position in the bitmaps. These bitmaps should be allocated in the shared memory accessible by a microcontroller (16) that is responsible for identifying the occurrence of a fire (i.e., steps 7–20 of FIG. 2) and the actuation of a fire alarm.

Figure 5:
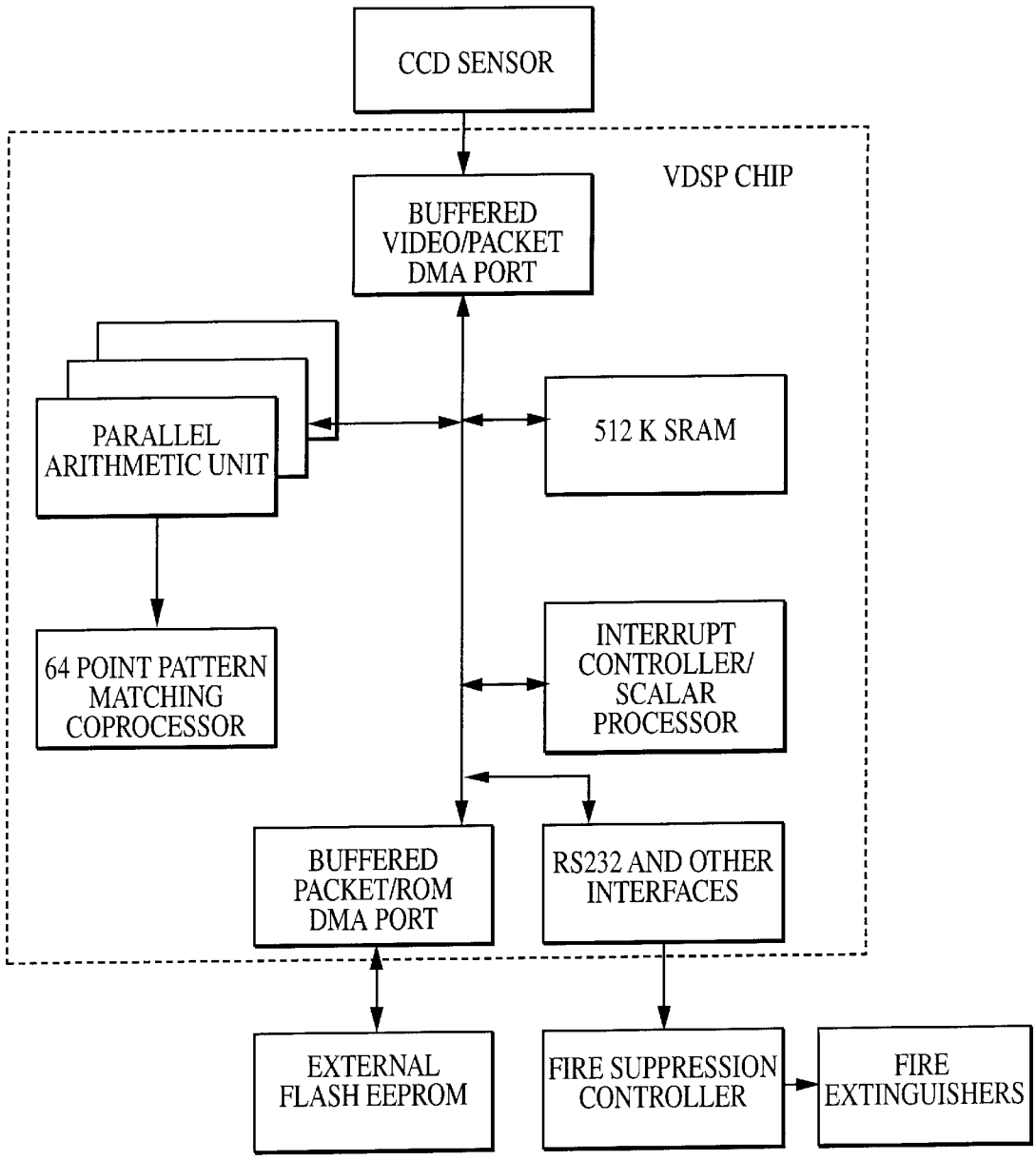
FIG. 5 illustrates the computational, hardware architecture for the apparatus referenced in FIG. 3.

The computational hardware architecture for such an embodiment of the present invention is shown in FIG. 5. It is based on a commercially, under-development Video DSP chip (A336) from Oxford Micro Devices, Inc. Such a chip incorporates a powerful parallel arithmetic unit optimized for image processing and a standard scalar processor. In addition, it includes 512K of fast, on-chip RAM and a DMA port that directly interfaces with a CCD image sensor. The control software can be loaded at startup, via a ROM/Packet DMA port, from programmed external EEPROM. Activation of fire alarm and fire suppression systems can be achieved via built-in RS232 or other interfaces.

This parallel arithmetic unit will be able to perform DSP filtering to separate the static and dynamic component of images having resolutions of up to 640×480 pixels. The clusters can be identified and analyzed in accordance to the algorithm of FIG. 2 using the scalar processor of the A336 chip. In case of the positive identification of an open flame, a signal will be issued via one of the standard interfaces, such as RS232, to a fire suppression controller, which in turn can activate fire extinguishers and/or other possible fire-response hardware.

Although the foregoing disclosure relates to preferred embodiments of the present invention, it is understood that these details have been given for the purposes of clarification only. Various changes and modifications of the invention will be apparent, to one having ordinary skill in the art, without departing from the spirit and scope of the invention as hereinafter set forth in the claims.

We claim:

1. A method of detecting fire in a monitored area, said method comprising the steps of:

detecting and capturing, at a prescribed frequency, video images of said monitored area in the form of two-dimensional bitmaps whose spatial resolution is determined by the number of pixels comprising said bitmaps, cyclically accumulating a sequential set of said captured bitmaps for analysis of the temporal variations in the brightness values observed at each of said pixels, said temporal variations being expressible in terms of a static and a dynamic component of said variations in pixel brightness values, examining said set of bitmaps to identify a static cluster of contiguous pixels having a static component of said brightness values that exceed a prescribed static threshold magnitude, examining said set of bitmaps to identify a dynamic cluster of contiguous pixels having a dynamic component of said brightness values that exceed a prescribed dynamic threshold magnitude, and comparing the patterns of the shapes of said identified, static and dynamic clusters to identify those exhibiting patterns which match to a predetermined matching level those exhibited by the comparable static and dynamic regions of the type of fire for which said area is being monitored.

2. A method of detecting fire as recited in claim 1, wherein said dynamic component is chosen as the magnitude of the brightness values being experienced at a frequency that is approximately equal to that of the main frequency exhibited in the turbulent flickering, coronal region of an open flame.

3. A method of detecting fire as recited in claim 2, further comprising the step of:

signaling the detection of a fire in said monitored area when the degree of match, between said identified, static and dynamic clusters and said comparable regions of the type of fire for which said area is being monitored, exceeds said predetermined matching level, wherein said identified, static and dynamic clusters are compared with the patterns exhibited by the comparable bright, static core and the dynamic coronal regions of flickering open flames.

4. A method of detecting fire as recited in claim 1, further comprising the step of signaling the detection of a fire in said monitored area when the degree of match, between said identified, static and dynamic clusters and said comparable regions of the type of fire for which said area is being monitored, exceeds said predetermined matching level.

5. A method of detecting fire as recited in claim 4, wherein said matching comprises the steps of scaling said patterns to a bitmap having a specified area, and processing said scaled bitmaps with a Neural network, pattern recognition algorithm to determine said level of matching.

6. A method of detecting fire as recited in claim 4, wherein said video images being formed by a plurality of video sensors operating in a spectral range that is characteristic of the type of fire for which said area is being monitored.

7. A method of detecting fire as recited in claim 4, wherein said signaling includes information regarding the severity of said fire and its position within said monitored area based on the geometric size and position of said clusters within said bitmaps.

8. A method of detecting fire as recited in claim 5, wherein said signaling includes information regarding the severity of said fire and its position within said monitored area based on the geometric size and position of said clusters within said bitmaps.

9. A method of detecting fire as recited in claim 1, wherein said matching comprises the steps of: scaling said patterns to a bitmap having a specified area, and processing said scaled bitmaps with a Neural network, pattern recognition algorithm to determine said level of matching.

10. A method of detecting fire as recited in claim 1, wherein said video images being formed by a plurality of video sensors operating in a spectral range that is characteristic of the type of fire for which said area is being monitored.

11. An apparatus for detecting fire in a monitored area, said apparatus comprising:

means for detecting and capturing, at a prescribed frequency, video images of said monitored area in the form of two-dimensional bitmaps whose spatial resolution is determined by the number of pixels comprising said bitmaps, means for cyclically accumulating a sequential set of said captured bitmaps for analysis of the temporal variations in the brightness values observed at each of said pixels, said temporal variations being expressible in terms of a static and a dynamic component of said variations in pixel brightness values, means for examining said set of bitmaps to identify a static cluster of contiguous pixels having a static component of said brightness values that exceed a prescribed static threshold magnitude, means for examining said set of bitmaps to identify a dynamic cluster of contiguous pixels having a dynamic component of said brightness values that exceed a prescribed dynamic threshold magnitude, and means for comparing the patterns of the shapes of said identified, static and dynamic clusters to identify those exhibiting patterns which match to a predetermined matching level those exhibited by the comparable static and dynamic regions of the type of fire for which said area is being monitored.

12. An apparatus for detecting fire as recited in claim 11, wherein said dynamic component is chosen as the magnitude of the brightness values being experienced at a frequency that is approximately equal to that of the main frequency exhibited in the turbulent flickering, coronal region of an open flame.

13. An apparatus for detecting fire as recited in claim 12, further comprising:

means for signaling the detection of a fire in said monitored area when the degree of match, between said identified, static and dynamic clusters and said comparable regions of the type of fire for which said area is being monitored, exceeds said predetermined matching level, wherein said identified, static and dynamic clusters are compared with the patterns exhibited by the comparable bright, static core and the dynamic coronal regions of flickering open flames.

14. An apparatus for detecting fire as recited in claim 11, further comprising:

means for signaling the detection of a fire in said monitored area when the degree of match, between said identified, static and dynamic clusters and said comparable regions of the type of fire for which said area is being monitored, exceeds said predetermined matching level.

15. An apparatus for detecting fire as recited in claim 14, wherein said matching comprises the steps of: scaling said patterns to a bitmap having a specified area, and processing said scaled bitmaps with a Neural network, pattern recognition algorithm to determine said level of matching.

16. An apparatus for detecting fire as recited in claim 14, wherein said video images being formed by a plurality of video sensors operating in a spectral range that is characteristic of the type of fire for which said area is being monitored.

17. An apparatus for detecting fire as recited in claim 14, wherein said signaling includes information regarding the severity of said fire and its position within said monitored area based on the geometric size and position of said clusters within said bitmaps.

18. An apparatus for detecting fire as recited in claim 15, wherein said signaling 8 includes information regarding the severity of said fire and its position within said monitored area based on the geometric size and position of said clusters within said bitmaps.

19. An apparatus for detecting fire as recited in claim 11, wherein said matching comprises the steps of: scaling said patterns to a bitmap having a specified area, and processing said scaled bitmaps with a Neural network, pattern recognition algorithm to determine said level of matching.

20. An apparatus for detecting fire as recited in claim 11, wherein said video images being formed by a plurality of video sensors operating in a spectral range that is characteristic of the type of fire for which said area is being monitored.

* * * * *